US006494759B1

(12) United States Patent
Polick

(10) Patent No.: US 6,494,759 B1
(45) Date of Patent: Dec. 17, 2002

(54) BOOK AND PAGES HAVING MECHANICAL MEANS FOR ACTIVATING POP-UP FIGURE

(75) Inventor: Peter Polick, New York, NY (US)

(73) Assignee: Innovative, USA, Inc., Norwalk, CT (US)

( * ) Notice: Subject to any disclaimer, the term of this patent is extended or adjusted under 35 U.S.C. 154(b) by 0 days.

(21) Appl. No.: 10/155,141

(22) Filed: May 24, 2002

(51) Int. Cl.[7] ..... A63H 33/38

(52) U.S. Cl. ..... 446/148; 446/73; 446/310; 281/15.1; 281/51

(58) Field of Search ..... 446/72–73, 147–148, 446/150–151, 309–311; 281/51, 15.1, 29; 434/393, 317

(56) References Cited

U.S. PATENT DOCUMENTS 2,367,373 A * 1/1945 Ralston
3,641,684 A * 2/1972 Paige ..... 35/8 A
3,768,175 A * 10/1973 Hill et al. ..... 35/9 R
4,608,024 A * 8/1986 Skolnick ..... 446/148
4,752,003 A * 6/1988 Miller et al. ..... 206/232
4,832,648 A * 5/1989 Theobald et al. ..... 446/72
D319,843 S * 9/1991 Thornell ..... D19/2
5,059,149 A * 10/1991 Stone ..... 446/73
5,681,199 A * 10/1997 Morris ..... 446/73
6,247,729 B1 * 6/2001 Kaufman ..... 281/22
2001/0013698 A1 * 8/2001 Soussan ..... 281/15.1

* cited by examiner

*Primary Examiner*—Derris H. Banks
*Assistant Examiner*—Jamila Williams
(74) *Attorney, Agent, or Firm*—Hedman & Costigan, P.C.

(57) ABSTRACT

A book and pages having a mechanical means for causing a figure associated with the theme of the book to pop-up upon opening the front cover, last page or other page of the book.

7 Claims, 5 Drawing Sheets

BOOK AND PAGES HAVING MECHANICAL MEANS FOR ACTIVATING POP-UP FIGURE

FIELD OF INVENTION

The present invention relates to a book that is useful in stimulating a child's imagination and/or desire to read and learn. More particularly, the present invention relates to a book with a cover and/or pages having a mechanical means for activating a pop-up figure. Most particularly, the present invention is related to a book having a simple mechanical means for directly causing a figure associated with the theme of the book to pop-up upon opening the front cover, last page or other page of the book.

BACKGROUND OF INVENTION

Devices for stimulating a child's imagination and/or desire to learn are well-known in the art. Books are especially useful in this regard. The market for children's books is highly competitive. Publishers are constantly developing features for books that they believe children will find appealing. Further, books intended for children are often designed to be educational and useful in teaching children reading skills and elementary concepts such as colors, shapes, counting, the alphabet, etc.

Books of the aforementioned types take many forms. For instance, Stone, U.S. Pat. No. 5,059,149, teaches a stuffed animal apparatus that includes one or more storage compartments in which visual and/or audio materials may be stored and displayed. The storage compartments are disposed in the stuffed animal body or in an appendage. Theobald et al., U.S. Pat. No. 4,832,648, teaches an animal figure that may be used as a cover for a book. Morris, U.S. Pat. No. 5,681,199, teaches a book wherein one or more of the covers or pages are bound with a spine containing a pop-up toy. The pop-up toy is activated by means of a crank on the spine of the book and/or an electronic device.

No prior art, however, teaches or suggests a book with a simple mechanical means for directly causing a figure associated with the theme of the book to pop-up upon opening the front cover, last page or other page of the book. Hence, the present invention is a useful tool for stimulating a child's imagination and/or desire to read and learn.

SUMMARY OF THE INVENTION

The present invention concerns a device that stimulates a child's imagination and/or desire to read and learn.

Thus, it is an object of the present invention to provide a useful children's book including a mechanical means for causing a figure associated with the theme of the book to pop-up upon opening the front cover, last page or other page of the book.

It is a further object of this invention to allow a user to develop reading, imagination, creativity, and thinking skills.

It is a further object of this invention to provide an outlet for educational entertainment that is easy to use and relatively cost-efficient to manufacture.

These and other objectives will become evident to those skilled in the art from the specification. To these ends, the book of the present invention comprises a front cover; a back cover; at least one page between the front and back covers; a housing for a pop-up figure; wherein at least one of the front cover, back cover or page are provided with a mechanical means for causing a figure associated with the theme of the book to pop-up upon opening the front cover, last page or other page of the book.

DETAILED DESCRIPTION OF THE INVENTION

The following description of preferred embodiments is presented to illustrate the present invention and is not to be construed to limit the scope of the appended claims in any manner whatsoever.

Figure 1:
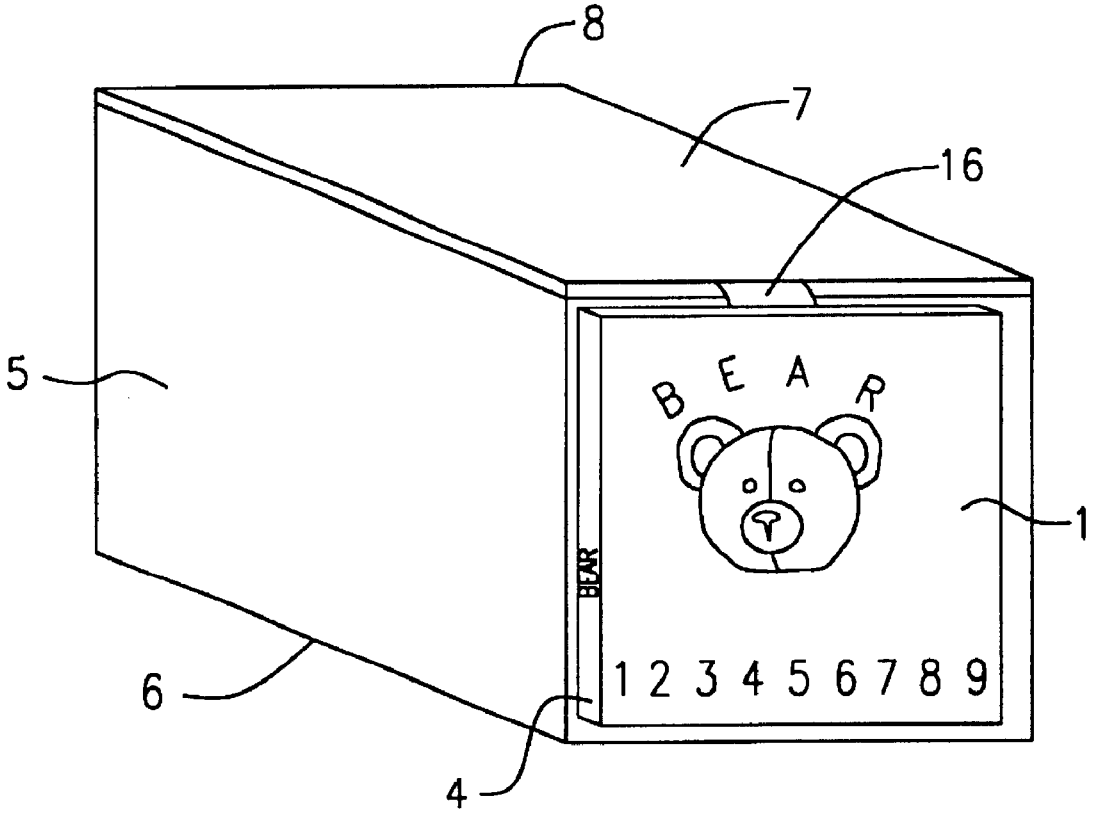
FIG. 1 depicts an embodiment of a book according to the present invention in the closed position.

Referring to FIG. 1, an embodiment of a book according to the present invention in the closed position is illustrated. The book includes a front cover 1, a back cover (not shown), a plurality of pages (not shown), and a housing 5. The covers and the pages are bound along one common side thereof by a binding 4 in any manner known to those skilled in the art.

The front cover 1, back cover (not shown), pages (not shown) and housing 5 may be constructed of any material known to those skilled in the art that provides sufficient rigidity and printability. These materials may include, but are not limited to, paper, cardboard, textiles, plastics or any combination thereof.

In a preferred embodiment of the present invention, the housing 5 is affixed to the back cover of the book by gluing the edges thereof to the edges of the panels. However, in other embodiments, the book may be attached by any other means known to those of ordinary skill in the art, such as, but not limited to, having the book detachable from the housing by means of Velcro® or sliding the back cover into a pocket formed on one side of the housing.

The housing 5 depicted is cubical, however, other shapes of the housing are conceivable and all are intended to be covered by the present invention. The housing 5 has a bottom portion 6 and a top lid 7. Lid 7 is pivotally attached to housing 5 by hinge means 8.

Figure 2:
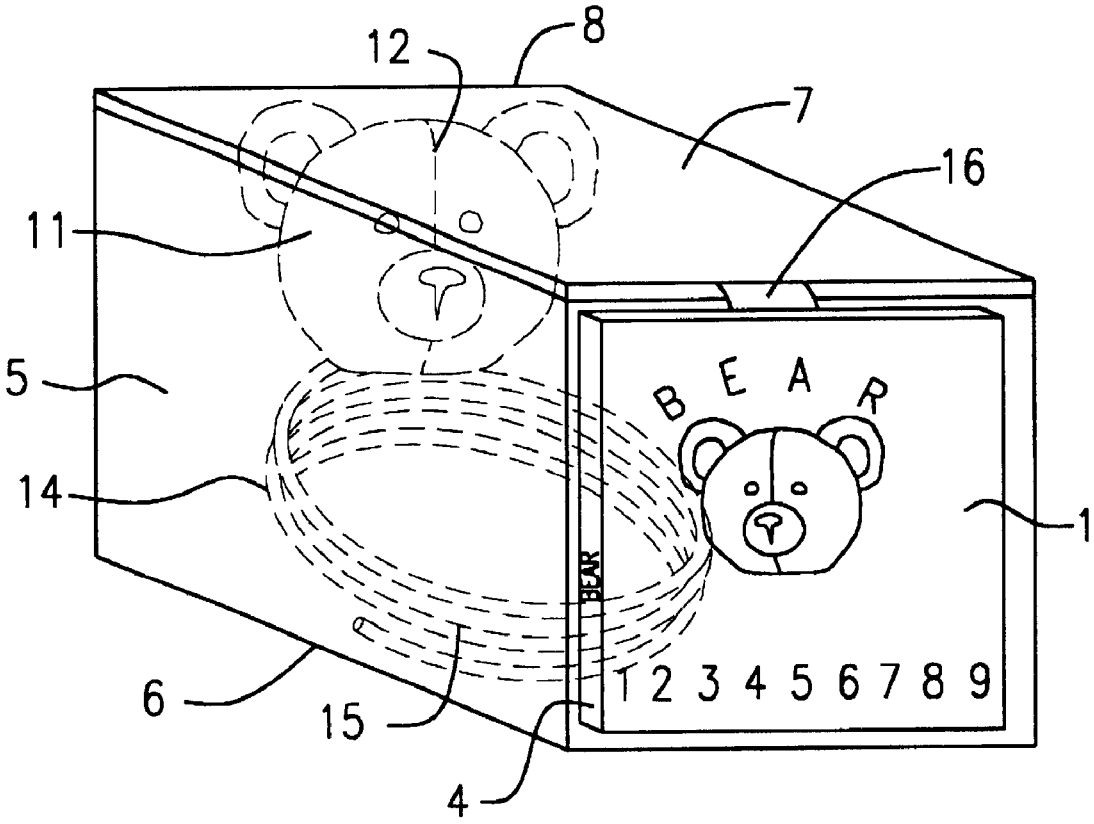
FIG. 2 depicts another view an embodiment of a book according to the present invention in the closed position wherein the pop-up figure and other interior aspects are shown.

Referring now to FIG. 2, a FIG. 11 is placed into the housing 5 through the lid 7. The FIG. 11 preferably includes a head part 12 and a sleeve part 14. The sleeve part 14 fits over a spring member 15 attached to and extending from the bottom portion 6 of the housing 5 to the head part 12 of the FIG. 11.

The head part 12 of the FIG. 11 is pushed below the level of the top opening of the housing 5 to compress the spring member 15. The lid 7 cooperates with the mechanical means 16 to hold the FIG. 11 within the housing 5. (As explained below, the mechanical means may comprise Velcro® tabs, a snap fastener or a magnetic closure.) Thus, when lid 7 is closed, the FIG. 11 is spring loaded within the housing 5 and held in place by the mechanical means 16. In the depicted embodiment, the mechanical means 16 is comprised of interlocking Velcro® tabs attached, respectively, to the lid 7 of the housing 5 and the back side of the front cover 1 of the book. However, in other embodiments, the mechanical means 16 may be comprised of a snap fastener or magnetic closure. Other embodiments of the mechanical means are also contemplated and will present themselves to those skilled in the art. It is also contemplated that the mechanical means 16 may be positioned between the lid and the last or other page of the book.

Figure 3:
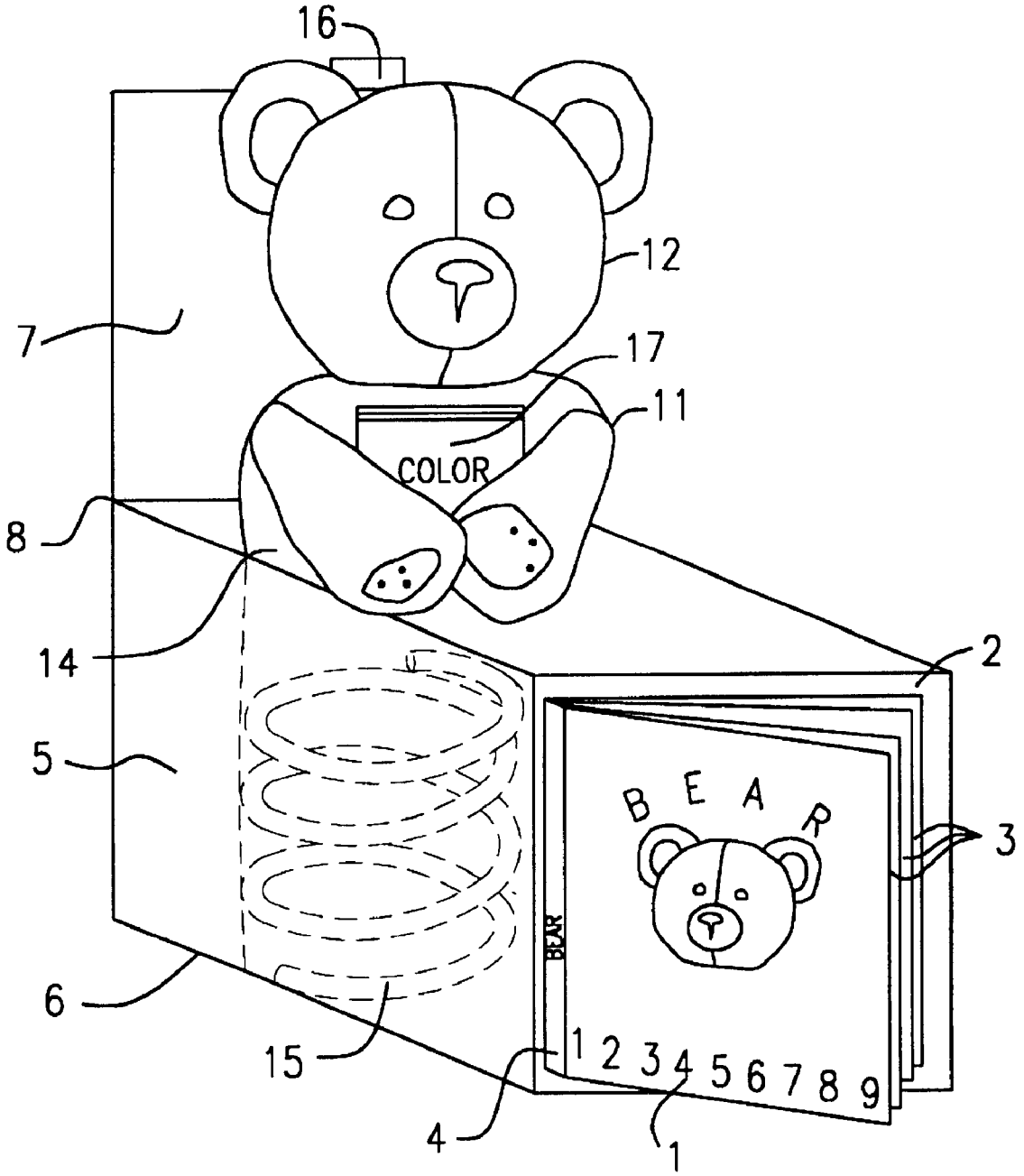
FIG. 3 depicts an embodiment of a book according to the present invention in the open position wherein the pop-up figure and other interior aspects are shown.

In order to operate the book, reference is had to FIG. 3. In the depicted embodiment, opening the front cover 1 activates the mechanical means 16 by separating the Velcro® tabs (or other fastener comprising the mechanical means) thereby releasing the pressure on the spring member 15 and causing the head part 12 of the FIG. 11 to push open the lid 7 of the housing and extend through the top opening of the housing 5.

Figure 4A:
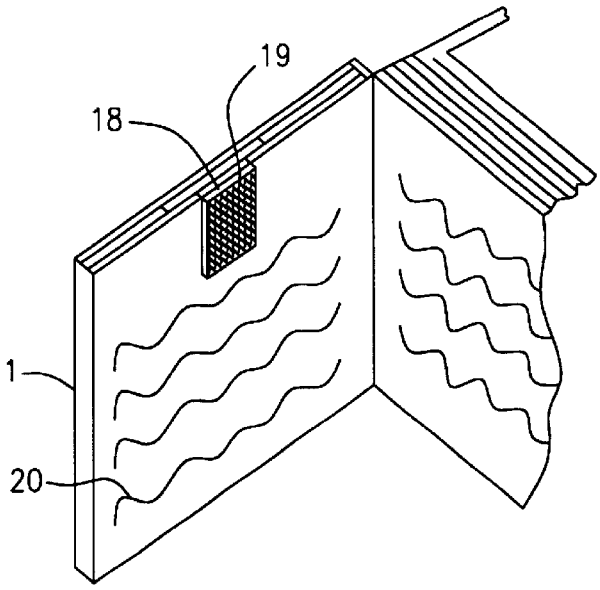
FIGS. 4A, 4B and 4C depict an embodiment of a front cover of a book according to the present invention.
Figure 4B:
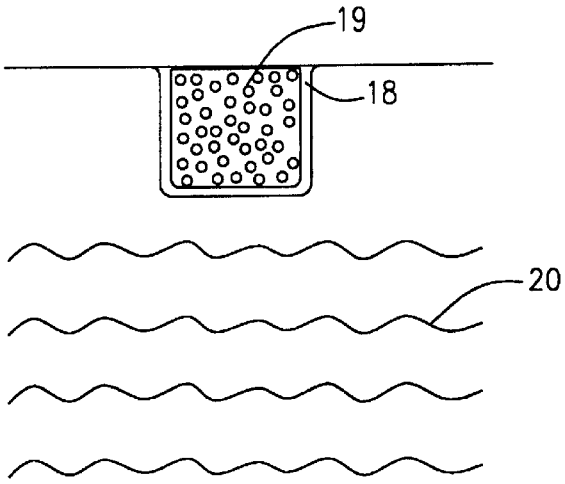
Figure 4C:
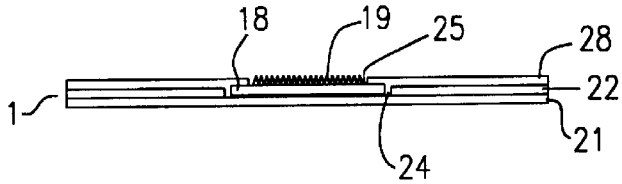

Referring to FIG. 4A, there is shown a preferred arrangement of the inside of book cover 1. As seen therein, book cover 1 is provided with text 20 and a tab 18 provided with Velcro® loops 19. Tab 18 can be attached to the inside of book cover 1 by gluing or other means. In an especially preferred embodiment, the tab is attached by recessing tab 18 between layers of book cover 1. FIG. 4B depicts an enlarged view of the tab 18. Referring to FIG. 4C, cover 1 is shown as constructed of three layers: outer layer 21, inner layer 28 and spacer layer 22. By providing a cut-out 24 in spacer layer 22 that is slightly larger than cut-out 25 of layer 23, a space is provided for inserting and sandwiching tab 18 between the layers. Velcro® loops 19 protrude from the cut-out 25 for engagement with Velcro® hooks 26 (see FIG. 5) on tab 16.

Figure 5:
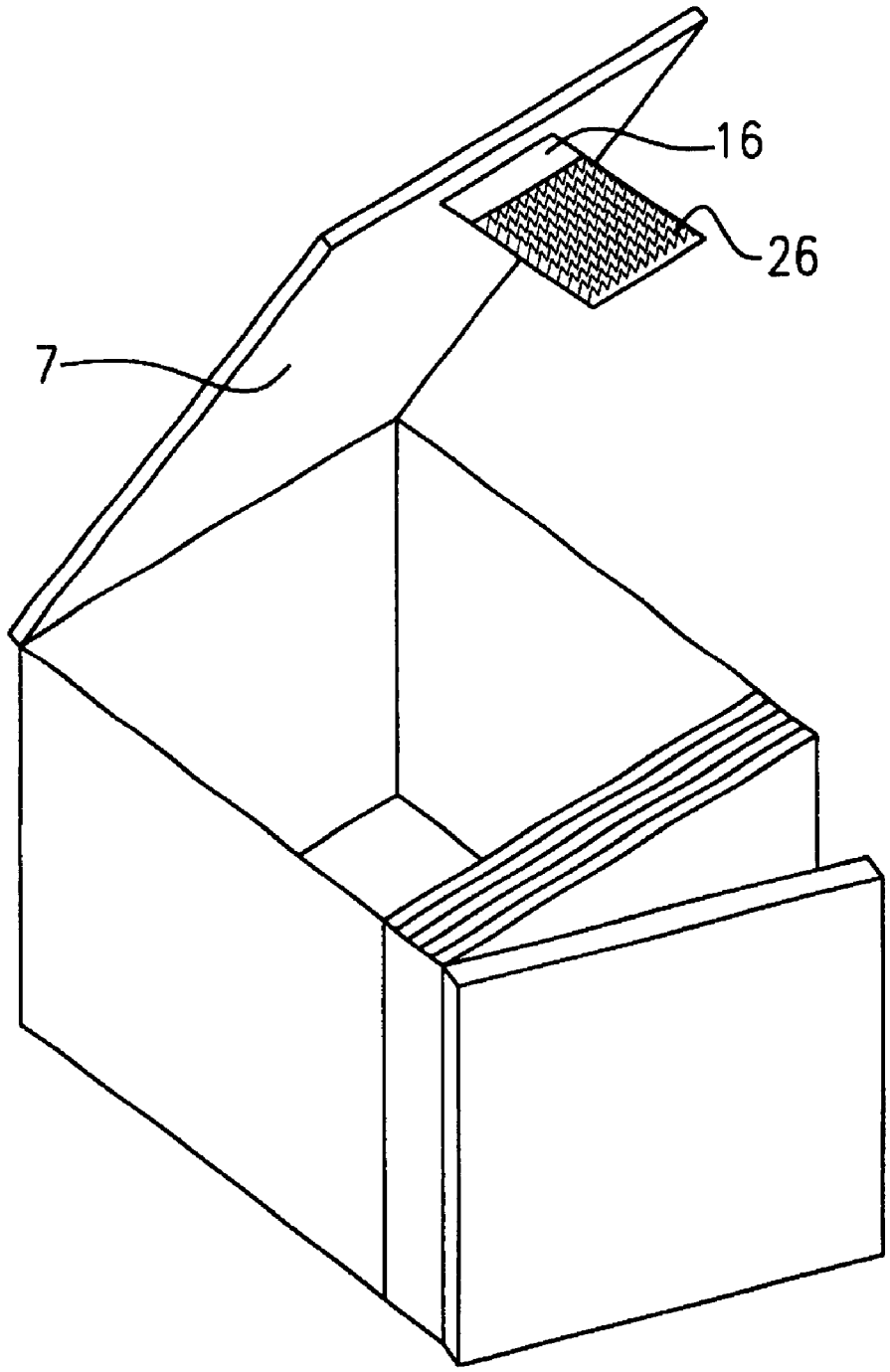
FIG. 5 depicts an embodiment of a housing lid according to the present invention.

Referring to FIG. 5, there is shown the inside of the lid 7. Lid 7 is provided with tab 16 having placed thereon Velcro® hooks 26. Tab 16 may be placed on lid 7 by use of an adhesive on the inside cover, or preferably by employing a sandwich-type construction as shown in FIG. 4B for tab 18. Likewise, the Velcro® hooks 26 may be attached to the surface of tab 16 by use of an adhesive, or by employing a similar sandwich-type construction.

In FIG. 3, the FIG. 11 remains visible while the book is being read. In other embodiments, the spring member need not be attached to the bottom 8 and the figure may thereby be propelled out of the housing when activated by the mechanical means. In still other embodiments several figures, such as snake figures, maybe propelled from the housing.

It is also contemplated that the mechanical means 16 may be positioned between the lid and the last or other page of the book such that the figure remains in the housing until such time as that page is reached. In this manner, the figure may be contained until an appropriate part of the story is reached and an element of surprise may be achieved.

With further reference to FIG. 3, the FIG. 11 may be provided with an attribute 17 that may be related to the theme of the book. In the depicted embodiment, the attribute is a book related to colors associated with the story. In other embodiments, the attribute may differ. For example, the attribute may comprise a book with answers to questions posed in the story or an object related to theme of the story.

The above referenced patents are hereby incorporated by reference. Many variations of the present invention will suggest themselves to those skilled in the art in light of the above-detailed description. All such modifications are within the full-intended scope of the claims.

What is claimed is:

1. A book and toy figure housing combination comprising:

(a) a book comprising a front cover, a back cover and a plurality of pages between said front and back covers, the front cover, back cover and plurality of pages being bound along one side by a binding means;

(b) a housing attached to said back cover, said housing having a hollow interior being provided with an openable lid;

(c) a toy figure suitable for placement in the interior of said housing, said toy figure comprising a spring member;

(d) wherein at least one of said front cover or plurality of pages comprises a mechanical closing means located on said openable lid, whereby closing the lid and engaging the mechanical closing means operates to springably load said toy figure within the housing interior and opening said front cover or plurality of pages operates to cause the figure to pop up out of the housing.

2. A book and toy figure combination as defined in claim 1 wherein said mechanical closing means is located on the front cover.

3. A book and toy figure combination as defined in claim 1 wherein said mechanical closing means is located on an interior book page.

4. A book and toy figure combination as defined in claim 1 wherein said mechanical closing means comprises interlocking hook and loop tabs.

5. A book and toy figure combination as defined in claim 1 wherein said toy figure is a character in the book.

6. A book and toy figure combination as defined in claim 1 wherein said figure comprises a head portion and a body sleeve portion; and wherein said spring member is attached to the bottom of said housing and said sleeve portion fits over said spring member.

7. A book and toy figure combination as defined in claim 2 wherein said front cover comprises and outer layer, an inner layer and a middle layer, wherein said middle layer and said inner layer are provided with cutouts, whereby a tab comprising said mechanical closing means is placed and secured in said cutouts in sandwiched fashion.

* * * * *